US012571176B2

(12) United States Patent
Femont et al.

(10) Patent No.: US 12,571,176 B2
(45) Date of Patent: Mar. 10, 2026

(54) PILES FOR SELF-CLOSING FLOOD BARRIER

(71) Applicant: FLOODSOLUTIONS NV, Schoten (BE)

(72) Inventors: Anthony Femont, Schilde (BE); Oliver Femont, Schilde (BE)

(73) Assignee: FLOODSOLUTIONS NV, Schoten (BE)

( * ) Notice: Subject to any disclaimer, the term of this patent is extended or adjusted under 35 U.S.C. 154(b) by 54 days.

(21) Appl. No.: 18/025,087

(22) PCT Filed: Sep. 8, 2021

(86) PCT No.: PCT/EP2021/074731
§ 371 (c)(1),
(2) Date: Mar. 7, 2023

(87) PCT Pub. No.: WO2022/053529
PCT Pub. Date: Mar. 17, 2022

(65) Prior Publication Data

US 2023/0323618 A1 Oct. 12, 2023

(30) Foreign Application Priority Data

Sep. 8, 2020 (BE) ..... 2020/5618

(51) Int. Cl.
*E02B 3/04* (2006.01)
*E02B 3/10* (2006.01)
*E02D 27/12* (2006.01)

(52) U.S. Cl.
CPC ..... *E02B 3/104* (2013.01); *E02D 27/12* (2013.01)

(58) Field of Classification Search
CPC . E02B 3/104; E02B 7/205; E02B 7/50; E02D 27/12
See application file for complete search history.

(56) References Cited

U.S. PATENT DOCUMENTS 4,377,352 A * 3/1983 Goodstein ..... E02B 7/20 405/115
5,460,462 A 10/1995 Regan
(Continued)

FOREIGN PATENT DOCUMENTS

DE 202008010500 U1 11/2010
WO 0001892 A1 1/2000
WO 2009145653 A1 12/2009

OTHER PUBLICATIONS

International Search Report from PCT Application No. PCT/EP2021/074731, Dec. 3, 2021.
(Continued)

*Primary Examiner* — Carib A Oquendo
(74) *Attorney, Agent, or Firm* — Workman Nydegger

(57) ABSTRACT

A pile mechanism to support water barrier elements in a self-closing flood barrier is described. The pile mechanism includes a pile that is arranged substantially beneath ground level when the water level is below the ground level, and that is automatically positioned above the ground level when the water level rises above the ground level. In some embodiments, the pile mechanism has a central float that is suited to cause the pile to rise at a water level that is higher than the ground level, a cover element suited to provide a water-tight seal between the pile and at least one water barrier element of the self-closing flood barrier, and a well having at least one flotation compartment from which the pile rises by means of the central float positioned in the flotation compartment.

15 Claims, 2 Drawing Sheets

(56) References Cited

U.S. PATENT DOCUMENTS

| | | | | |
|---|---|---|---|---|
| 10,036,133 | B2 * | 7/2018 | Adler | E02B 7/26 |
| 2009/0169302 | A1 * | 7/2009 | Alpern | E02B 3/104 405/33 |
| 2011/0268506 | A1 * | 11/2011 | Thornbury | E02B 7/205 405/118 |
| 2012/0134750 | A1 * | 5/2012 | Fujita | E02B 7/205 405/111 |
| 2016/0201281 | A1 * | 7/2016 | Roy | E02B 3/104 405/107 |
| 2019/0177940 | A1 * | 6/2019 | Van den Noort | E02B 3/062 |

OTHER PUBLICATIONS

Search Report from Belgian Application No. BE2020/5618, Jun. 9, 2021.

* cited by examiner

PILES FOR SELF-CLOSING FLOOD BARRIER

FIELD OF THE INVENTION

The present invention relates to systems and methods for flood prevention. More specifically, the present invention concerns a pile for a self-closing flood barrier, a method for the use of such a pile and self-closing flood barrier comprising such a self-actuating pile to prevent flooding of the land behind it. More specifically, the present invention concerns piles that are also self-actuating and thus cause no hindrances when the self-closing flood barrier is inactive.

BACKGROUND OF THE INVENTION

Self-closing flood barriers that can be placed, e.g., on a riverbank or a sea wall are dams in which a water barrier element is automatically driven upward from a housing when the housing is filled with water, and drops when the water flows out of the housing. When the water level is low, the water barrier element is underground in the housing, which is the open state of the self-closing flood barrier in which the water barrier element does not cause any hindrance, e.g. to traffic. This is advantageous compared to conventional dams, in which a water barrier element remains permanently above ground and is immobile, thus, for example, blocking traffic even when the water level is low. In the case of the self-closing flood barrier, the water barrier element automatically rises from the ground when the water level is high, thus placing the self-closing flood barrier in a closed state and protecting the land behind it from being flooded by the rising water. When closed, the self-closing flood barrier provides the same general protection of the land behind it from flooding that a conventional dam provides.

In order to ensure that the length of the self-closing flood barrier is sufficient, various water barrier elements are usually provided and placed between piles.

In the state of the art, most often, the piles that form the support for the plates to form the barrier, are continuously above ground, regardless of the water level, and move the water barrier elements above or below ground depending on water level. Because the piles remain stationary regardless of the water level, they present a hindrance both to visibility and, e.g., traffic when the self-closing flood barrier is open.

Thus, there remains a need in the art for large, robust self-closing flood barriers that cause little or no hindrance when open.

SUMMARY OF THE INVENTION

It is an object of the present invention to provide a pile mechanism for a self-closing flood barrier, wherein the self-closing flood barrier causes less hindrance when open, as well as a corresponding self-closing flood barrier, and a method for protecting land behind it from flooding. One advantage of embodiments according to the present invention is that a long, self-closing flood barrier can be obtained, thus allowing the dam to be segmented and structured with intermediate piles without these piles being constantly visible.

One advantage of embodiments of the present invention is that differences in altitude of the land can be compensated by using two self-closing flood barriers of different heights that are connected by means of an intermediate pile.

One advantage of embodiments of the present invention is that two or more self-closing flood barriers can be placed so as to form an acute angle with one another.

The aforementioned object is met by a system and a method as claimed in the present invention.

In a first aspect, the present invention concerns a pile mechanism for supporting water barrier elements in a self-closing flood barrier, wherein the pile mechanism comprises a pile that is substantially below ground level when the water level is below ground level, and that is automatically positioned above ground level when the water level is above ground level.

It is an advantage of embodiments of the present invention that it can provide a long dam without the need for permanent intermediate piles. Because self-raising pile mechanisms can be used as intermediate piles, these piles may thus disappear under ground level when the water level is lower than ground level. This avoids the view being disturbed by intermediate piles for a dam when the water barrier elements (screens or cloths) are not positioned above ground level. Because the intermediate piles between the water barrier elements (screens or cloths) can also sink below ground level when the water level is below ground level, it is also possible to obtain a better flow, e.g., of traffic at a such a water level.

The pile mechanism may comprise a central float that is suited to cause the pile to rise at a water level above ground level, wherein the pile comprises a cover element that is suited to provide a watertight seal between the pile and at least one water barrier element of the self-closing flood barrier.

One advantage of embodiments of the present invention is that a good seal is obtainable between a non-permanent intermediate pile and a water barrier element of the self-closing flood barrier.

The pile mechanism may further comprise a well having at least one flotation compartment, from which the pile rises by means of the central float positioned in the flotation compartment.

The well may comprise an activation compartment that has access to water above the ground level and, when it is filled, directs the water currents to at least the flotation compartment in the well in order to activate the flotation of the pile.

The well may further comprise an additional overflow compartment that can be connected with one or more wells of water barrier elements of the self-closing flood barrier, and wherein the additional compartment is configured such that the water flows from the overflow compartment to the one or more wells of the water barrier elements once the flotation compartment is full.

The activation compartment may be separately accessible via a lid.

The watertight seal may be formed by means of a rubber seal.

The watertight seal may comprise a reversible seal between the pile and at least one water barrier element of the self-closing flood barrier.

The watertight seal may comprise a reversible seal between the pile and a self-raising water barrier screen of the self-closing flood barrier.

The watertight seal may comprise a permanent seal between the pile and a water barrier cloth. The water barrier cloth may thus be permanently attached to the pile.

In another aspect, the present invention concerns a self-closing flood barrier comprising a pile mechanism as described above.

The self-closing flood barrier may comprise water barrier elements of different heights.

The self-closing flood barrier may comprise two parts that are watertightly connected when closed and that make an acute angle.

In a further aspect, the present invention concerns the use of a pile mechanism and/or a self-closing flood barrier as described above in order to protect the land behind it from flooding.

Specific and preferred aspects of the invention are contained in the independent and dependent claims appended hereto. Features of the dependent claims may be combined, as appropriate, with features of the independent claims and with features of additional dependent claims and not merely as explicitly stated therein.

To summarise the invention and the advantages it provides compared to the prior art, specific objectives and advantages of the invention are described above. It should, of course, be understood that all of these objectives or advantages may not necessarily be attained by every specific embodiment of the invention. Thus, for example, persons skilled in the art will understand that the invention can be embodied in a way that provides or optimises one or more advantages set forth herein without necessarily attaining other objectives or advantages stated or suggested herein.

The aforementioned and other aspects of the invention will be better understood by reference to the embodiment(s) described below.

BRIEF DESCRIPTION OF THE FIGURES

The invention will now be described in greater detail, by way of example and by reference to the related figures, in which.

Figure 1A:
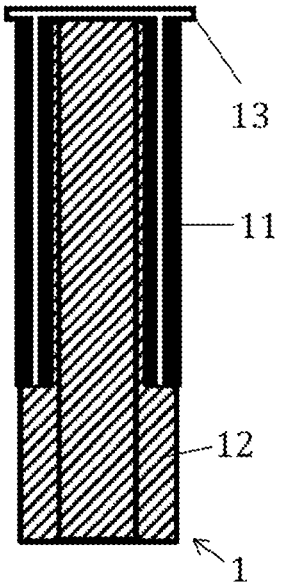
FIG. 1A, FIG. 1B, and FIG. 1C show various views of a pile according to embodiments of the present invention.

The figures are intended for illustration and not limitation. In the figures, for better illustration, the dimensions of some components may be exaggerated and not to scale. The dimensions and relative dimensions may not necessarily be consistent with actual embodiments of the invention.

Reference numerals in the claims shall not be construed as limiting the scope of the invention.

In the various figures, like reference numerals refer to the same or similar elements.

DETAILED DESCRIPTION OF EXEMPLARY EMBODIMENTS

The present invention will be described in relation to specific examples and by reference to certain drawings; however, this shall not constitute a limitation of the invention, which is limited only by the claims.

In the description and the claims, the terms 'first', 'second', 'third', and the like are used to distinguish similar elements and not necessarily to describe a sequence, whether temporal, spatial, hierarchical, or otherwise. It should be understood that the terms, as used, may be interchangeable in certain circumstances, and that the embodiments of the invention described herein are capable of operating in a sequence other than that described or reproduced herein.

Additionally, the terms 'top', 'bottom', 'above', 'in front of', and the like in the description and claims are used for description purposes and not necessarily in order to describe relative positions. It should be understood that the terms as used may be interchangeable under certain circumstances, and that the embodiments of the invention described herein may operate in other orientations than those described or reproduced herein.

It should be noted that the term 'comprise', as used in the claims, should not be construed as limiting the claim to the means described thereafter; this term does not exclude any other elements or steps. It should be construed as specifying the presence of the features, values, steps, or components referred to, without excluding the presence or addition of one or more other features, values, steps, components, or groups thereof. Thus, the scope of the expression 'a mechanism comprising elements A and B' should not be limited to mechanisms comprising only components A and B. This means that, in relation to the present invention, A and B are the only relevant components of the mechanism.

Any reference in this specification to 'one embodiment' or 'an embodiment' means that a specific feature, structure, or characteristic described in relation to the embodiment is included in at least one embodiment of the present invention. Thus, the expressions 'in one embodiment' or 'in an embodiment' throughout this specification do not necessarily refer to the same embodiment, although they may do so. Furthermore, the specific features, structures, or characteristics may be combined in any suitable manner, as should be clear to persons skilled in the art on the basis of this disclosure, in one or more embodiments.

Likewise, it should be noted that, in the description of exemplary embodiments of the invention, various features of the invention are sometimes grouped in a single embodiment, figure, or description thereof, in order to streamline the disclosure and aid in understanding one or more of the various aspects of the invention. This method of disclosure should not, however, be construed as reflecting an intention that the invention requires any more features than those explicitly set forth in each claim. Instead, as reflected by the following claims, aspects of the invention are not included within all features of a single previously disclosed embodiment. Thus, the conclusions following the detailed description are explicitly incorporated thereinto by reference, with each individual claim constituting a separate embodiment of the present invention.

Furthermore, whilst some embodiments described herein include some, but not all, features included in other embodiments, combinations of features of different embodiments are meant to fall within the scope of the invention, and form different embodiments, as will be understood by persons skilled in the art. For example, in the following claims, any of the embodiments described may be used in any combination.

In the description provided here, numerous specific details are stated. However, it should be understood that embodiments of the invention may be executed without these specific details. In other cases, well-known procedures, structures, and techniques are not described in detail in order to simplify the description.

In a first aspect, the present invention concerns a pile mechanism for supporting water barrier elements in a self-closing flood barrier. Such a pile mechanism is typically part of a self-closing flood barrier, or is arranged between two self-closing flood barriers that are positioned one after another. For example, they may be positioned at an angle to one another. By using a pile mechanism having piles, a self-closing flood barrier may also be segmented, such that long self-closing flood barriers may be provided or differences in land altitude may be taken into account. The pile mechanism comprises a pile that is arranged substantially beneath ground level when the water level is below the ground level, and that is automatically positioned above the ground level when the water level rises above the ground level. In this way, not only the water barrier elements, but the piles themselves may be sunk into the ground when the dam is open.

In some embodiments, the pile comprises a central float that is suited to cause the pile to rise at a water level that is higher than the ground level, a cover element suited to provide a water-tight seal between the pile and at least one water barrier element of the self-closing flood barrier, and a well having at least one flotation compartment from which the pile rises by means of the central float positioned in the flotation compartment.

In some embodiments, the pile mechanism is suited to form a watertight seal with floating bulkheads when operating. Alternatively, one or more pile mechanisms may also be permanently connected with a water barrier cloth that serves as a water barrier screen. In this case, the pile mechanism also serves to lift the water barrier cloth.

By way of example, various essential and optional features of the system will be described in detail by reference to FIGS. 1A, 1B, and 1C, which show a pile 1 comprising a cover element 11, a central float 12, and a pile lid 13. FIG. 1A is a front view, FIG. 1B a side view, and FIG. 1C a bottom view of the pile. In this example, the float 12 is located in the middle of the pile 1. The float 12 is suited to float on water, e.g. because it has a lower density than water, e.g. because it is made of a material having a lower density than water or because it comprises a sealed cavity containing air. In preferred embodiments, the float 12 is suited to cause the entire pile to float on water. In this example, the float 12, as seen from below, is T-shaped, but the present invention is not limited thereto. In other embodiments, for example, the float 12, as seen from below, may be square or round or irregular in shape. In this embodiment, the float 12 is nearly as high as the pile, which may have the advantage that the pile 1 as a whole has quite low density compared to water and thus can easily and quickly float in water. In other embodiments, the float 12 may, however, also be a small part of the pile 1.

In this embodiment, the float 12 is partially surrounded by the cover element 11. In this example, there is a slit between the cover element 11 and the float 12, into which an element of a well can be pushed so as to prevent the pile 1 tilting relative to the well. The cover element 11 preferably comprises a stiff material such as metal, preferably a non-corrosive metal. Furthermore, the cover element 11 is adapted so as to connect the pile 1 with a water barrier element, e.g. by means of a watertight seal between the pile 1 and the water barrier element. For example, this may be obtained by fastening the watertight seal to the pile 1, e.g. on the cover element 11. In some embodiments, the cover element 11 comprises the watertight seal. When the dam comprising the pile 1 and a water barrier element is closed, the watertight seal may press against the water barrier element, with the pressure ensuring that no water may pass between the water barrier element and the pile 1. The advantage of this embodiment is that the pile 1 and the water barrier element are not fastened to one another. This allows the pile 1 and the water barrier element to float to differing extents, e.g. at different heights. This may be advantageous when the pile 1 and the water barrier element differ in altitude, e.g. because the ground surface is not flat, e.g. hilly. In certain embodiments, the pile 1 and the water barrier element are connected by means of a watertight seal.

In the example, the pile 1 comprises the pile lid 13; as such, if the pile 1 is blocked substantially below a surface, the hole in which the pile 1 is located can be covered by the pile lid 13.

Figure 1B:
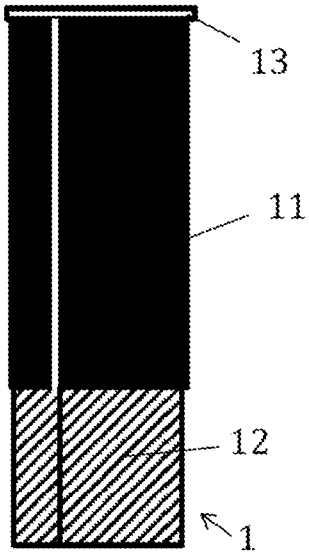
Figure 1C:
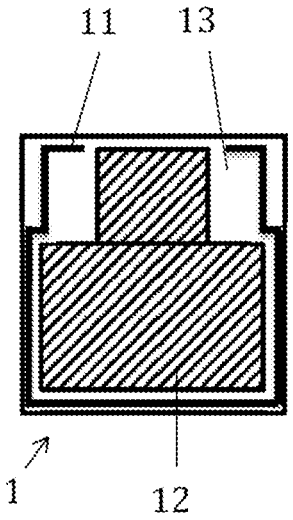
Figure 2A:
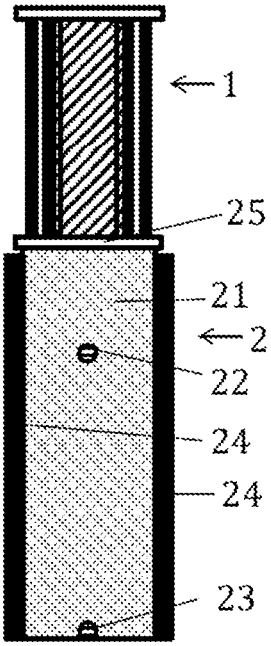
FIG. 2A, FIG. 2B, and FIG. 2C show various views of a pile according to embodiments of the present invention.
Figure 2B:
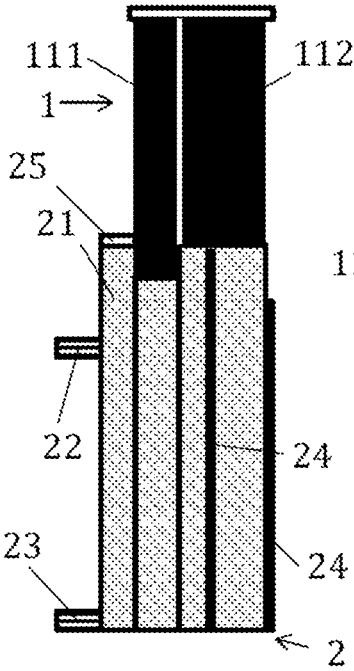
Figure 2C:
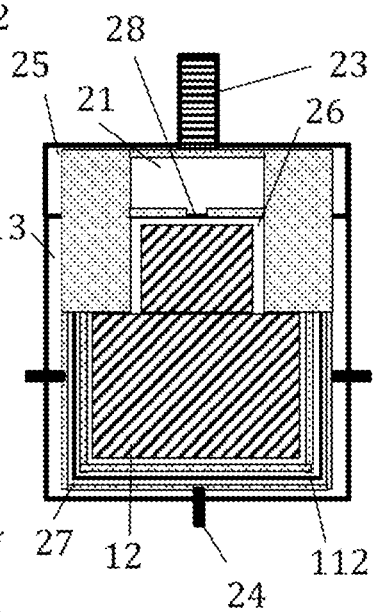

FIG. 2A, FIG. 2B, and FIG. 2C show a pile comprising a pile 1, the pile 1 being the same pile as shown in FIGS. 1A, 1B, and 1C, and a well 2, according to embodiments of the present invention. Here, FIG. 2A is a front view, FIG. 2B a side view, and FIG. 2C a bottom view of the pile. The float 12 here is partially arranged in a flotation compartment 26 of the well 2. The pile is shown here in the closed state, i.e. with the pile 1 partially outside of the well 2. The well 2 may, for example, be dug into the ground and thus be substantially underground. When open, the pile 1 is substantially inside the well 2, and thus also substantially underground.

The pile passes from the open state, in which the pile 1 is substantially inside the well 2, to the closed state, e.g. because water flows into an activation compartment 21 via an inlet pipe 22 due to high water above ground, i.e. when the water level is above the ground level. Then, the water flows, e.g. via a passage 28, into the flotation compartment 26, thus pushing up the pile 1. This partially pushes the pile 1 out of the well, thus placing the pile in the closed state. When the above-ground water level sinks below ground level, the water in the flotation compartment 26 may flow out of the well 2 via the activation compartment 21 and the outlet pipe 23; thus, no force is pushing the pile 1 upward any longer, and the pile 1 then sinks, disappearing again into the well 2, and the pile returns to the open state.

In this embodiment, the well 2 comprises a slit 27 into which the first part of the cover element 112 of the pile 1 may be pushed. When the pile is closed, the first part of the cover element 112 is substantially inside the slit 27. Because the first part of the cover element 112 can be slid into the slit 27, the pile 1 cannot tilt relative to the well 2, which can ensure the stability of the pile 1, even, e.g., in the event of waves. A second part of the cover element 111 is outside of the well 2 both when the pile is open and when it is closed. This serves to create a good connection between the pile 1 and an adjacent water barrier element, e.g. via a watertight seal that is part of, or fastened to, the second part of the cover element 111, thus making a good connection to the area below the ground surface possible.

The activation compartment 21 comprises a lid 25, e.g. allowing for inspection and cleaning of the activation compartment 21. In this embodiment, the well 2 comprises wings 24 in order to immobilise the well 2 in the ground. This allows the well 2, for example, to remain stable and not tilt relative to the ground surface, even if waves act on the pile 1.

In a second aspect, the present invention concerns a self-closing flood barrier, wherein the self-closing flood barrier comprises a pile mechanism according to an embodiment of the pile mechanism from the first aspect of the present invention. The self-closing flood barrier may take the form of a long, self-closing flood barrier that is segmented into various parts. The self-closing flood barrier may also consist of various parts that form an angle, e.g., an acute angle, with one another.

Figure 3A:
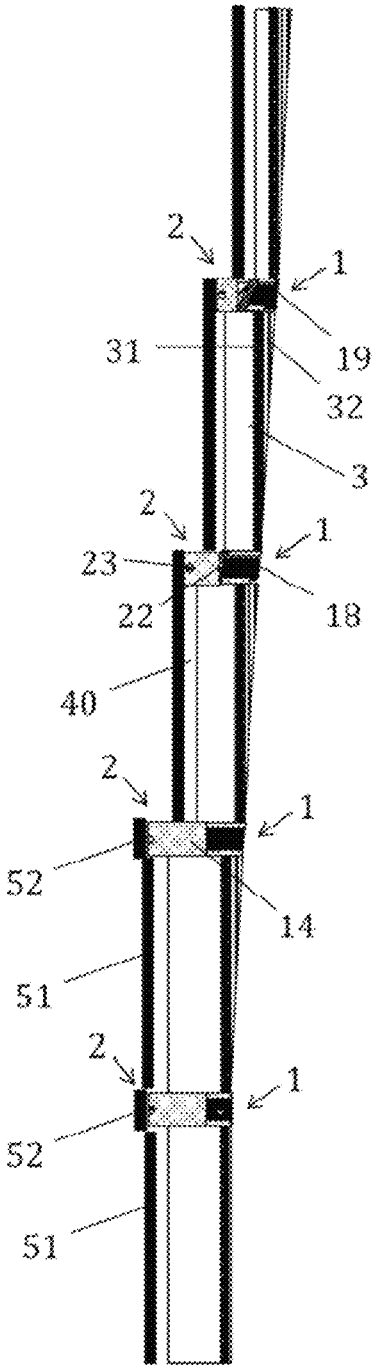
FIG. 3A and FIG. 3B show a self-closing flood barrier according to embodiments of the present invention in its open and closed states, respectively.
Figure 3B:
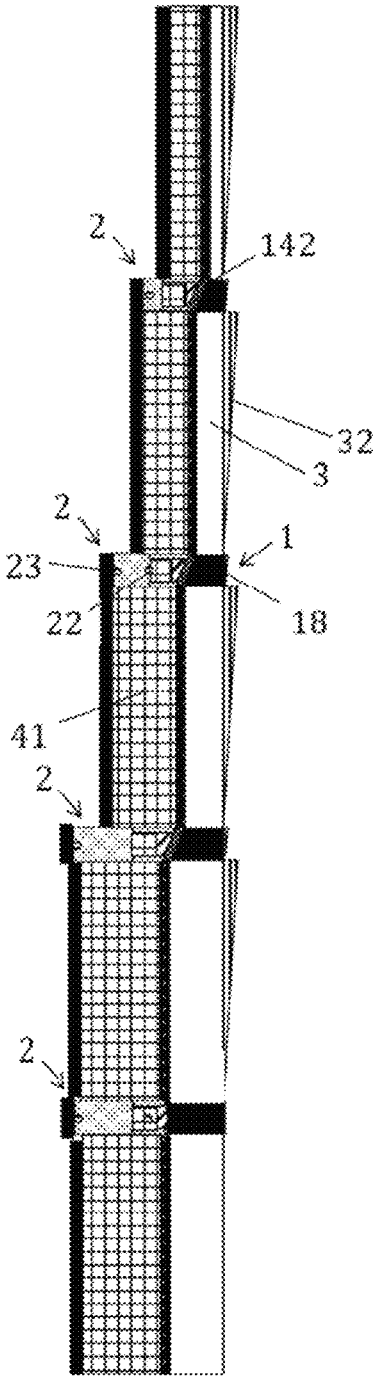

One example of the second aspect of the present invention can be seen in FIG. 3A, showing a self-closing flood barrier in the open state, and FIG. 3B, which shows the self-closing flood barrier in the closed state. Here, the self-closing flood barrier comprises a pile mechanism according to embodiments of the first aspect of the present invention, the pile mechanism comprising a well 2 and a pile 1 that is partially inserted into the well 2, and water barrier elements 3 between and on either side of the piles. When the self-closing flood barrier is open, each water barrier element is blocked within a well (not shown), wherein the well comprises a top side 31 having an opening on its top, through which the water barrier element can move upward and downward. The water barrier elements 3 comprise a float, wherein the float, and, with it, the entire water barrier element 3 can be pushed upward by water, e.g. when water flows into a space 40 in the well of the water barrier element.

In this example, the ground surface under which the self-closing flood barrier is placed is not flat, but angled. For this reason, the top side 31 of the well of the various water barrier elements 3 is not always arranged at the same height: The higher the ground surface on which the well is located, the higher the top side 31 of the well of a water barrier element 3 through which the water barrier element can move upward. The top side 31 is preferably not under the ground surface. This difference in height also applies to the top side of the wells 2 of the piles 1. In this example, the water barrier elements 3 differ in height because, when the dam is closed, they can reach equal heights in this example: The higher the top side 31 of the well of the water barrier element 3, the lower the water barrier element 3 itself can be in order to be as high as other water barrier elements when the self-closing flood barrier is closed.

In this example, the ground surface under which the self-closing flood barrier is located is angled. A number of the water barrier elements 3 and piles 1 have an angled top side 32, 18, such that, when the water barrier elements 3 and piles 1 are under the ground and the self-closing flood barrier is thus open, the top sides 32, 18 conform to the angled ground surface, and holes in the surface through which the piles 1 and water barrier elements 3 can move upwards or downwards are closed. Thus, when the self-closing flood barrier is open, the piles 1 and water barrier elements 3 are firmly held under the ground surface, and do not, for example, hinder through traffic and without any holes in the ground surface.

In this example, the wells 2 of the piles 1 and the wells of the water barrier elements 3 stand on concrete base plates 51 and 52, such that the wells 2 of the piles 1 and the wells of the water barrier elements 3 are kept stable in the ground, including relative to one another, and cannot, for example, sink deeper into the ground.

If a water level is higher than ground level, water 41 may flow via an inlet 22 into the well, thus pushing the pile 1 upwards and partially out of the well 2 and positioning it above the ground surface. In this example, the well of the piles 1 comprises an overflow compartment (not shown) that is connected with the wells of the water barrier elements 3, such that water 41 can flow from the well 2 of the piles 1 into the wells of the water barrier elements 3, i.e. into the spaces 40 containing the water barrier elements 3. Thus, the water 41 also pushes the water barrier element 3 upwards and out of the space 40 above the ground surface. In this manner, the self-closing flood barrier passes from the open state, shown in FIG. 3A, to the closed state, shown in FIG. 3B, with the piles 1 and water barrier elements 3 positioned above the ground level. If the water level is below the ground level, the water 41 may flow via an outlet 23 out of the wells of the water barrier elements 3 and the wells 2 of the piles 1; thus, the piles 1 and water barrier elements 3 are no longer pushed upwards and move back under ground. In this way, the self-closing flood barrier returns to the open state.

In this example, the piles 1 and water barrier elements 3 are substantially equal in height when the self-closing flood barrier is closed. This is a preferred embodiment: The water level retained by the dam is limited by the pile 1 or the water barrier element 3, the top of which is the lowest, thus resulting in unnecessary use of material in piles 1 or water barrier elements 3 that are higher than the pile 1 or water barrier element 3 with the lowest top side. However, it is not necessary for the piles 1 and water barrier elements 3 to be equal in height, and differences in height amongst the piles 1, amongst the water barrier elements 3, or between the piles 1 and water barrier elements 3, are also possible.

When the self-closing flood barrier is closed, the piles 1 support the adjacent water barrier elements 3. The support can be obtained, e.g., by the piles 1 pressing against the adjacent water barrier elements 3 when the dam is closed, with the water barrier elements 3 being held in place by the piles 1 in this manner. The support can also be obtained, e.g., by two piles 1 clamping the water barrier element 3 that is between the two piles 1. On the other hand, the support can be obtained by a connection between the pile 1 and the adjacent water barrier elements 3, e.g. with the pile comprising rails on either side to which the water barrier element 3 can be movably attached. This support makes it possible to prevent the water barrier elements 3, e.g., tilting or moving up and down, e.g. under the influence of waves. In particular, this is prevented when the piles 1 themselves cannot tilt and are thus highly stable themselves, e.g. because each pile 1 is fastened within a well 2 so as to prevent tilting.

As already noted above, a watertight seal is positioned between each pile 1 and each adjacent water barrier element 3. The watertight seal ensures that, when the self-closing flood barrier is closed, there is no gap between the pile 1 and the adjacent water barrier elements 3 through which above-ground water might flow.

On its underside, possibly between the pile 1 and the well 2, the pile 1 may comprise a gasket in order to prevent water flowing between the pile 1 and the well 2, which would allow above-ground water to flow from one side of the dam to the other. When the dam is closed, the gasket is preferably as high up as possible within the well 2, so as to prevent that water flows, e.g., through a hole, wherein the hole is formed by a first space between the pile 1 and the well 2, and a second space above the gasket and under a watertight seal between the pile 1 and the water barrier element. Preferably, the gasket is thus directly below the surface when the dam is closed. In some cases, there is a difference in height between the top sides 31 of the wells of water barrier elements 3 on either side of a pile. This makes it possible, e.g., for a pile 1 to protrude partially above the ground, whilst one part of a side of the pile 1 protruding above ground does not touch a water barrier element 3. Above-ground water should not be able to flow through this along the pile 1, with the pile 1 not being in contact with a water barrier element 3. In order to compensate for this difference in height, piles 1 may comprise an angled gasket 142 on their bottom sides. This prevents above-ground water flowing under the piles 1 or between the piles 1 and the water barrier elements 3.

This allows the self-closing flood barrier to protect the land behind it effectively against flooding, even if the ground surface is not flat. The self-closing flood barrier according to this example comprises several parts, thus making it easy to lengthen the self-closing flood barrier. When closed, however, the self-closing flood barrier described does not hinder traffic, not even by means of piles protruding over the surface when closed, as is the case with known-art conventional dams.

The foregoing description provides details of certain embodiments of the invention. However, it should be clear that, no matter how detailed the foregoing text is, the invention can be modified in numerous ways. It should be noted that the use of certain terms in describing certain features or aspects of the invention must not be construed as implying that the terminology is being redefined herein in order to limit to certain features of the features or aspects of the invention with which this terminology is related.

The invention claimed is:

1. A pile mechanism to support water barrier elements in a self-closing flood barrier, wherein the pile mechanism comprises a pile that is arranged substantially beneath ground level when a water level is below the ground level, and that is automatically positioned above the ground level when the water level rises above the ground level;

wherein the pile mechanism is configured for moving the pile independent of the water barrier elements, and wherein the pile mechanism is configured to support an adjacent water barrier element, when the adjacent water barrier element, comprising a float, is pushed upward by water.

2. The pile mechanism according to claim 1, wherein the pile mechanism comprises a central float that is suited to cause the pile to rise when the water level is higher than the ground level, and wherein the pile comprises a cover element that is suited to provide a watertight seal between the pile and at least one water barrier element of the self-closing flood barrier.

3. The pile mechanism according to claim 2, wherein the pile mechanism further comprises a well having at least one flotation compartment, from which the pile rises by means of the central float positioned in the flotation compartment.

4. The pile mechanism according to claim 3, wherein the well comprises an activation compartment that has access to water above the ground level and, when it is filled, directs water currents to at least the flotation compartment in the well in order to activate the flotation of the pile.

5. The pile mechanism according to claim 4, wherein the activation compartment is separately accessible via a lid.

6. The pile mechanism according to claim 3, wherein the well further comprises an additional overflow compartment that can be connected with one or more wells of water barrier elements of the self-closing flood barrier, and wherein the additional compartment is configured such that the water flows from the overflow compartment to the one or more wells of the water barrier elements once the flotation compartment is full.

7. The pile mechanism according to claim 2, wherein the watertight seal is formed by means of a rubber seal.

8. The pile mechanism according to claim 2, wherein the watertight seal comprises a reversible seal between the pile and at least one water barrier element of the self-closing flood barrier.

9. The pile mechanism according to claim 8, wherein the watertight seal comprises a reversible seal between the pile and a floating water barrier screen of the self-closing flood barrier.

10. The pile mechanism according to claim 2, wherein the cover element and float are separated by a slit adapted to receive a well element to prevent tilting of the pile.

11. The pile mechanism according to claim 2, wherein the watertight seal comprises a permanent seal between the pile and a water barrier fabric.

12. A self-closing flood barrier comprising a pile mechanism according to claim 1.

13. The self-closing flood barrier according to claim 12, wherein the self-closing flood barrier comprises water barrier elements of different heights.

14. The self-closing flood barrier according to claim 12, wherein the self-closing flood barrier comprises two parts that, when closed, are connected in a watertight manner and form an acute angle.

15. A method for using the pile mechanism according to claim 1 to protect land located behind it from flooding, the method comprising the steps of:

automatically positioning a pile, which is arranged substantially beneath ground level when the water levels is below the ground level, above the ground level when the water level rises above the ground level.

* * * * *